US010005298B2

(12) United States Patent
Pang et al.

(10) Patent No.: US 10,005,298 B2
(45) Date of Patent: Jun. 26, 2018

(54) DOUBLE-PAPER-ROLL PRINTING DEVICE

(71) Applicant: GRG BANKING EQUIPMENT CO., LTD., Guangzhou, Guangdong (CN)

(72) Inventors: Kaiyin Pang, Guangdong (CN); Jinming Pan, Guangdong (CN); Aiming Wu, Guangdong (CN); Zeyan Guan, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days. days.

(21) Appl. No.: 15/320,035

(22) PCT Filed: Jul. 27, 2015

(86) PCT No.: PCT/CN2015/085187

§ 371 (c)(1),
(2) Date: Dec. 19, 2016

(87) PCT Pub. No.: WO2016/019816

PCT Pub. Date: Feb. 11, 2016

(65) Prior Publication Data

US 2017/0197443 A1 Jul. 13, 2017

(30) Foreign Application Priority Data

Aug. 4, 2014 (CN) ..... 2014 1 0380586

(51) Int. Cl.
*B41J 15/22* (2006.01)
*B41J 15/04* (2006.01)
(Continued)

(52) U.S. Cl.
CPC ..... *B41J 15/042* (2013.01); *B41J 3/4075* (2013.01); *B41J 15/20* (2013.01); *B41J 15/22* (2013.01)

(58) Field of Classification Search
CPC ..... B41J 3/4075; B41J 15/22; B41J 14/042
See application file for complete search history.

(56) References Cited

U.S. PATENT DOCUMENTS 4,808,800 A 2/1989 Nishijima et al.
4,868,674 A 9/1989 Nakamura et al.
(Continued)

FOREIGN PATENT DOCUMENTS

CN 1166407 A 12/1997
CN 101190592 A 6/2008
(Continued)

OTHER PUBLICATIONS

International Search Report for PCT/CN2015/085187, dated Oct. 19, 2015, ISA/CN.
(Continued)

*Primary Examiner* — Kristal Feggins
*Assistant Examiner* — Kendrick Liu
(74) *Attorney, Agent, or Firm* — U.S. Fairsky LLP; Yue Xu

(57) ABSTRACT

A double-paper-roll printing device includes an installation frame for installing the following components and paper rolls. A first paper roll and a second paper roll are installed on the installation frame through a paper roll supporting shaft. Paper tapes of the first paper roll and the second paper roll are selectively fed to a printing component through paper passages. The first paper roll and the second paper roll are selectively fed to the printing component through a first paper passage and a second paper passage that are mutually independent. The first paper passage and the second paper passage are mutually superposed. The tail end of the first paper passage and the tail end of the second paper passage
(Continued)

form an intersecting end, and paper tape heads of the paper rolls enter the printing component through the intersecting end.

8 Claims, 7 Drawing Sheets

(51) Int. Cl.
*B41J 3/407* (2006.01)
*B41J 15/20* (2006.01)

(56) References Cited

U.S. PATENT DOCUMENTS

| | | | | |
|---|---|---|---|---|
| 6,030,133 | A | 2/2000 | Endo | |
| 6,550,908 | B1 | 4/2003 | La Poste | |
| 2002/0130941 | A1 | 9/2002 | Tanaami | |
| 2004/0263606 | A1* | 12/2004 | Kato | B41J 11/002 347/219 |
| 2008/0131185 | A1 | 6/2008 | Kim | |
| 2011/0198802 | A1* | 8/2011 | Tozaki | G07F 19/20 271/279 |

FOREIGN PATENT DOCUMENTS

| | | | |
|---|---|---|---|
| CN | 101391535 | A | 3/2009 |
| CN | 101941335 | A | 1/2011 |
| CN | 201703039 | U | 1/2011 |
| CN | 201841764 | U | 5/2011 |
| CN | 201950966 | U | 8/2011 |
| CN | 201989423 | U | 9/2011 |
| CN | 102658732 | A | 9/2012 |
| CN | 202480556 | U | 10/2012 |
| CN | 102815101 | A | 12/2012 |
| CN | 102873992 | A | 1/2013 |
| CN | 104129177 | A | 11/2014 |
| JP | S5739981 | A | 3/1982 |
| JP | 2002356022 | A | 12/2002 |
| JP | 2006008353 | A | 1/2006 |

OTHER PUBLICATIONS

Extended European Search Report for corresponding Application No. 15829967.7 dated Dec. 1, 2017.

* cited by examiner

DOUBLE-PAPER-ROLL PRINTING DEVICE

This application is a National Phase entry of PCT Application No. PCT/CN2015/085187, filed Jul. 27, 2015, which claims the benefit of priority to Chinese patent application No. 201410380586.9, titled "DOUBLE-PAPER-ROLL PRINTING DEVICE", filed with the Chinese State Intellectual Property Office on Aug. 4, 2014, the entire disclosures of which are incorporated herein by reference.

FIELD

This application relates to a printing device, and particularly to a double-paper-roll printing device of a self-service equipment, which achieves a free switch between two paper rolls with different types.

BACKGROUND

In the industries such as rail transportation, finance and banking, papermaking, printing, medical health, electrical power, supermarket, lottery, catering, POS terminal and the like, a paper transaction voucher is required to provide to users. Related transaction information is required to be printed on the paper transaction voucher instantly, therefore, currently, in order to achieve a continuous voucher printing, a roll of paper is generally provided for printing or cutting, and the paper roll may be replaced as desired.

For extending the continuous printing time of a printing device and thus avoiding frequent replacement of the paper roll, a conventional solution is to increase the amount of a paper tape by increasing a diameter of the paper roll, thus, the continuous printing time is extended. Another solution is to increase the number of paper rolls. Although the solution to increase the number of paper rolls may achieve the extension of printing time of printing equipment, the equipment would be more complicated. Further, it is difficult in a certain degree in technique to switch the paper rolls, thus paper is apt to be jammed frequently. Therefore, the technical issue sought to be addressed by those skilled in the art continually is to provide a printing equipment, which takes up space as less as possible, reduces the risk of paper jam and facilitates clearance and maintenance even in the case that paper jam occurs.

SUMMARY

To overcome the defects of the conventional printing device, the present application provides an open-type double-paper-roll printing device in which smaller operation space is needed to replace the paper roll.

The double-paper-roll printing device includes an installation frame for installing the following components and paper rolls. A first paper roll and a second paper roll are installed on the installation frame by a first paper roll supporting shaft and a second paper roll supporting shaft. Paper tapes of the first paper roll and the second paper roll are selectively fed to a printing component through paper passages. The first paper roll and the second paper roll are selectively fed to the printing component respectively through a first paper passage and a second paper passage that are mutually independent. The first paper passage and the second paper passage are mutually superposed. A tail end of the first paper passage and a tail end of the second paper passage form an intersecting end, and paper tape heads of the paper rolls enter the printing component by the intersecting end.

Preferably, one common paper passage is provided between the printing component and the intersecting end formed by the tail end of the first paper passage and the tail end of the second paper passage.

Further, a sensor for detecting the paper tapes is provided in the common paper passage.

Preferably, the first paper passage and the second paper passage comprise a first paper passage top assembly, a middle assembly and a second paper passage lower assembly. The middle assembly includes two passage faces, i.e., a first passage face and a second passage face which are respectively adjacent to the first paper passage and the second paper passage. The first paper passage comprises the first passage face and the first paper passage top assembly, and the second paper passage comprises the second passage face and the second paper passage lower assembly.

Preferably, the first paper passage top assembly is pivotally connected to the middle assembly, and the middle assembly is further pivotally connected to the second paper passage lower assembly.

Preferably, a paper cutting assembly for cutting off the paper tape that has been printed is provided outside a paper-exit passage of the printing component.

Further, a paper delivering passage for delivering a paper sheet out is further provided outside the paper cutting assembly of the printing component. The paper delivering passage is pivotally connected to the installation frame by one rotation shaft, and a selective separation of the paper transportation passage from the paper cutting assembly is achieved.

Preferably, the first paper roll and the second paper roll are supported by the first paper roll supporting shaft and the second paper roll supporting shaft fixed to the installation frame. One end of the paper roll supporting shaft is a free end and selectively locked by a movable baffle which is pivotally connected to the installation frame by a baffle rotation shaft.

Further, a tension spring is provided between the movable baffle and the installation frame, and the tension spring has two ends respectively fixed to the movable baffle and the installation frame.

Further, the free end of the paper roll supporting shaft is provided with a position-limiting slot, and the movable baffle is provided with a lock plate having an automatic reset function corresponding to the position-limiting slot.

When compared with the conventional technology, the present application has the following advantageous effects:

1. in the technical solution of the present application, the paper passages for two paper rolls are designed to be mutually independent and the passage assemblies that are formed by the two independent paper passages are mutually superposed and pivotally connected in turn and form open passages, which is beneficial to the clearance of the paper jam in the passages;

2. the installation of a paper roll is achieved by replacing from a side. One end of the paper roll supporting shaft is a free end, so that the paper roll may be replaced from the side. In this way, the maintenance operation space needed by the equipment is reduced as much as possible. Also, the free end is selectively locked by a movable baffle, which not only ensures a safe operation of the equipment but also saves the space taken up the equipment.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings of the present application in the following description are only some examples of the present application, and for the person skilled in the art, other drawings may be obtained based on these drawings without any creative efforts.

DETAILED DESCRIPTION

To further illustrate the double-paper-roll printing device according to the present application, the preferred embodiments of the present application will be described further in detail hereinafter in conjunction with the drawings thereof.

Figure 1:
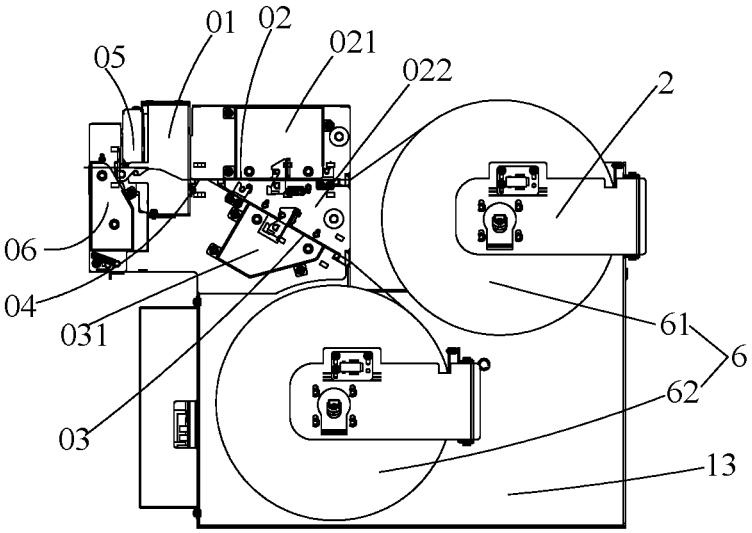
FIG. 1 is a schematic view of a double-paper-roll printing device according to the present application.
Figure 2:
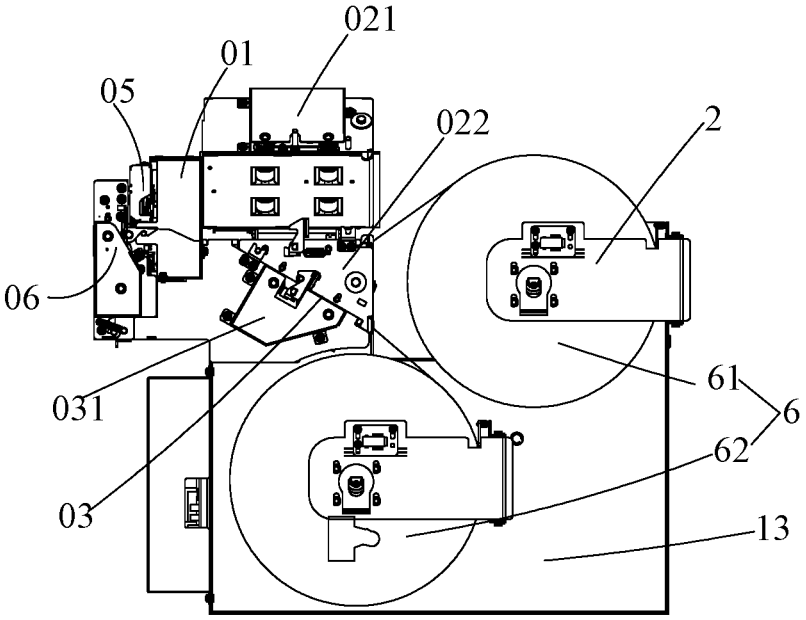
FIG. 2 is a schematic view of a first paper passage of the double-paper-roll printing device shown in FIG. 1 with the first paper passage opened.
Figure 3:
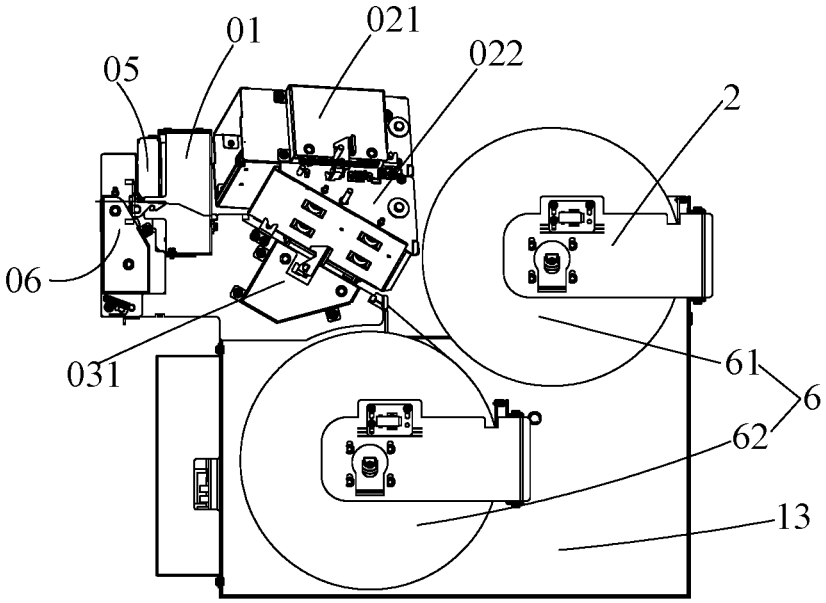
FIG. 3 is a schematic view of a second paper passage of the double-paper-roll printing device shown in FIG. 1 with the second paper passage opened.
Figure 6:
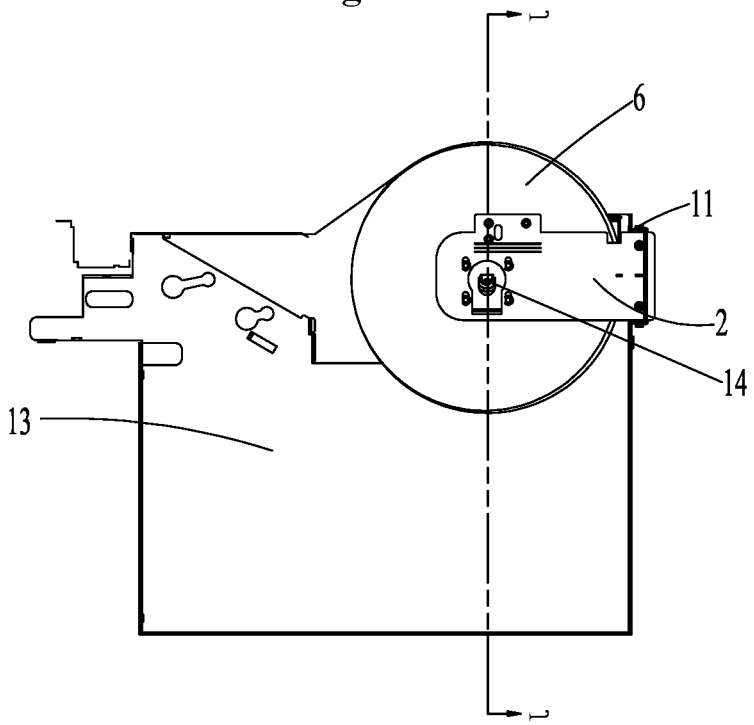
FIG. 6 is a schematic view of a paper roll installation mechanism of the double-paper-roll printing device shown in FIG. 1.

Referring to FIGS. 1 and 6, the double-paper-roll printing device according to the present application includes an installation frame 13 for installing following components and paper rolls 6. A first paper roll 61 and a second paper roll 62 are installed on the installation frame 13 by a first paper roll supporting shaft and a second paper roll supporting shaft. Paper tapes of the first paper roll 61 and the second paper roll 62 are selectively fed to a printing component 01 through paper passages. Specifically, the first paper roll 61 and the second paper roll 62 are selectively fed to the printing component 01 respectively through a first paper passage 02 and a second paper passage 03 that are mutually independent. The first paper passage 02 and the second paper passage 03 are mutually superposed. A tail end of the first paper passage 02 and a tail end of the second paper passage 03 form an intersecting end, and paper tape heads of the paper rolls enter the printing component 01 by the intersecting end. In order to achieve a smooth abutment between the first paper passage 02, second paper passage 03 and a paper tape passage in the printing component 01, one common paper passage 04 is provided between the printing component 01 and the intersecting end formed by the tail end of the first paper passage 02 and the tail end of the second paper passage 03. Further, in order to detect and determine whether a paper tape is passing in the above paper passages and determine the type of the paper tape, the first paper passage 02, the second paper passage 03 and the common paper passage 04 are each provided with a sensor for detecting the paper tape so as to determine and control a paper selection of the first paper roll 61 and the second paper roll 62 and how long the paper passes, and the like. The working process of the sensor is the common knowledge in the art, which would not be described herein.

Figure 4:
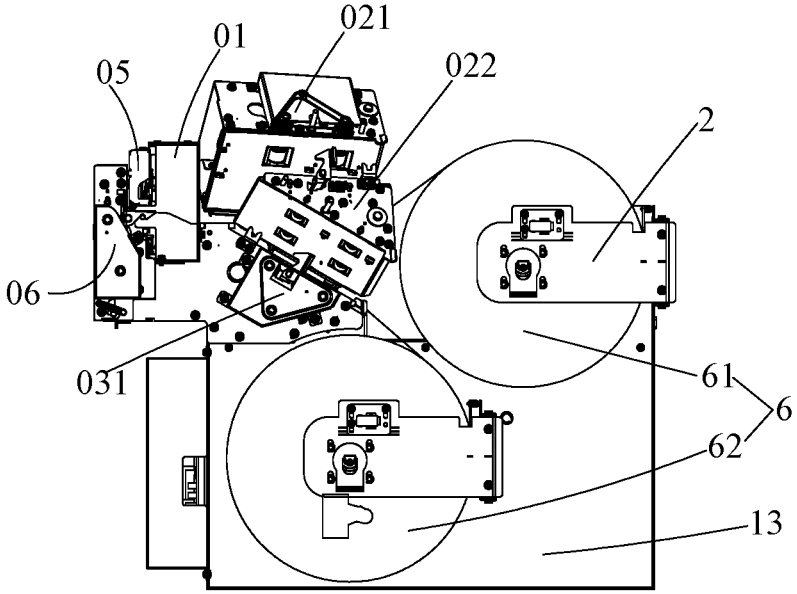
FIG. 4 is a schematic view of the first and second paper passages of the double-paper-roll printing device shown in FIG. 1 with the first and second paper passages opened.
Figure 5:
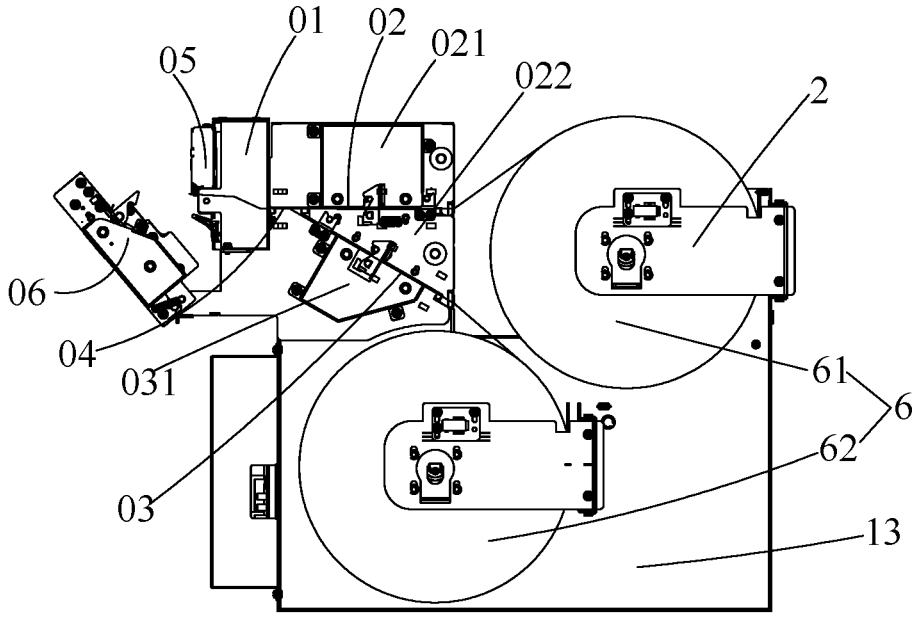
FIG. 5 is a schematic view of a paper feeding passage of the double-paper-roll printing device shown in FIG. 1 with the paper feeding passage opened.

Referring to FIGS. 1 to 5, the first paper passage 02 and the second paper passage 03 comprise a first paper passage top assembly 021, a middle assembly 022 and a second paper passage lower assembly 031. The middle assembly 031 includes two passage faces, i.e., a first passage face 0221 and a second passage face 0222 which are respectively adjacent to the first paper passage 02 and the second paper passage 03. The first paper passage 02 comprises the first passage face 0221 and the first paper passage top assembly 021. The second paper passage 03 comprises the second passage face 0222 and the second paper passage lower assembly 031. The first paper passage top assembly 021 is pivotally connected to the middle assembly 022 by a rotation shaft. The middle assembly 022 is further pivotally connected to the second paper passage lower assembly 031 by another rotation shaft. Thus, the first paper passage 03 and the second paper passage 03 can be opened, which facilitates the clearance of faults occurred in the paper passages, as shown in FIG. 4. Further, in order to separate the paper tape that has been printed, a paper cutting assembly 05 for cutting off the paper tape that has been printed is provided outside a paper-exit passage of the printing component 01, which is used for cutting the paper tape that has been printed by the printing component 01 from the paper roll. In order to deliver a paper sheet that has been cut off to the outside of the equipment, a paper delivering passage 06 for delivering the paper sheet out is further provided outside the paper cutting assembly 05 of the printing component 0. The paper transportation passage 06 is pivotally connected to the installation frame 13, and a selective separation of the paper transportation passage 06 from the paper cutting assembly is achieved, as shown in FIG. 5.

As shown in FIG. 6, the paper roll 6 is installed on the installation frame 13 by the first paper roll supporting shaft and the second paper roll supporting shaft. One end of the paper roll supporting shaft 14 is a free end and is selectively locked by a movable baffle 2, which is pivotally connected to the installation frame 13 by a baffle rotation shaft 11.

Figure 7:
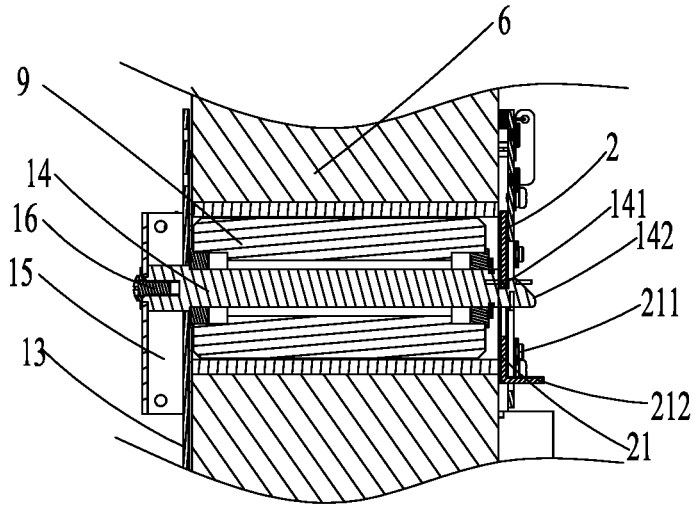
FIG. 7 is a partial sectional schematic view of the paper roll installation mechanism shown in FIG. 6 taken along J-J.

For allowing the movable baffle 2 to reliably block the paper roll 6, as shown in FIG. 7, the free end of the paper roll supporting shaft 14 is provided with a position-limiting slot 141, and corresponding to the position-limiting slot 141, the movable baffle 2 is provided with a lock plate 21, and the lock plate 21 can return automatically. For allowing the lock plate 21 to be freely inserted into the position-limiting slot 141, the free end of the paper roll supporting shaft 14 includes an inclined guiding surface 142, which is used for guiding the lock plate 21 into the position-limiting slot 141 from the free end.

Figure 8:
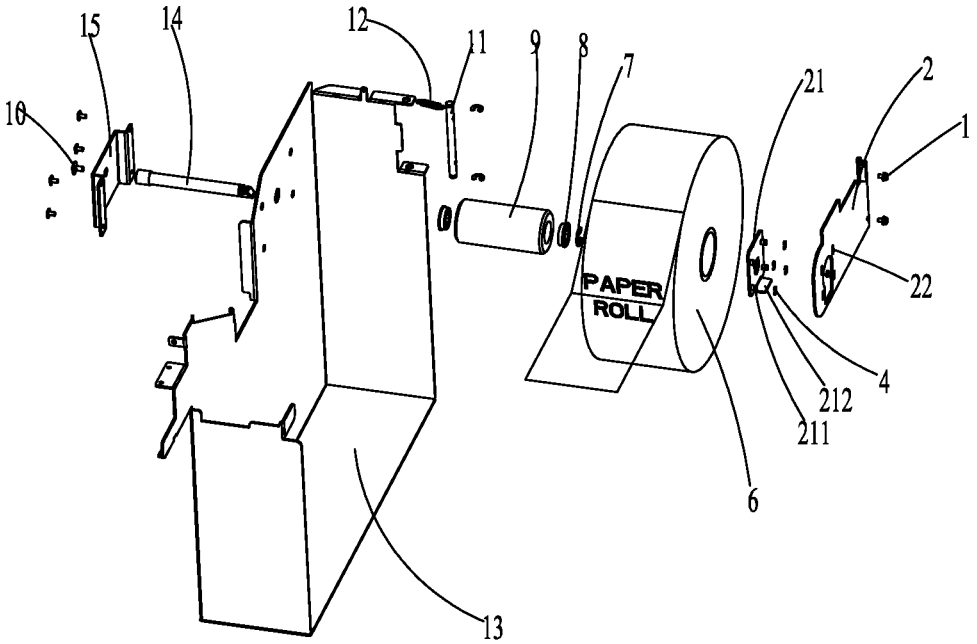
FIG. 8 is an exploded schematic view of parts of the paper roll installation mechanism shown in FIG. 6.

As shown in FIG. 8, for allowing the lock plate 21 to selectively lock the paper roll supporting shaft 14, the lock plate 21 has a slide travel on the movable baffle 2, and the lock plate is provided with four sliding columns 211, and the movable baffle 2 is provided with sliding grooves 22 corresponding to the sliding columns 211. The lock plate 21 automatically returns under the action of gravity. Further, for facilitating unlocking the lock plate 21 when replacing the paper roll 6, the lock plate 21 is provided with a release-operation handle 212.

For facilitating the opening and closing of the movable baffle 2, a tension spring 12 is provided between the movable baffle 2 and the installation frame 13 in the double-paper-roll printing device according to the present application. Two ends of the tension spring 12 are respectively fixed to the movable baffle 2 and the installation frame 13. Also, when the movable baffle 2 is opened or closed, both of the two fixing points of the tension spring 12 are not in a line with the baffle rotation shaft 11.

Reference is made to FIG. 8. For allowing the paper roll 6 to be freely rolled on the paper roll supporting shaft 14, the paper roll supporting shaft 14 is sleeved with a paper roll shaft core 9 in a rolling manner. The paper roll 6 is movably sleeved on the paper roll shaft core 9. A rolling element 8 is arranged between the paper roll shaft core 9 and the paper roll supporting shaft 14. Such design allows the roll core of the paper roll 6 to be in line contact with the paper roll shaft core 9, which makes the friction force between the roll core of the paper roll 6 and the paper roll shaft core 9 small and thus facilitates the paper roll 6 rotating in the printing. Two rolling elements 8, which generate small friction, are provided between the paper roll core 9 and the paper roll supporting shaft 14. In this way, it is easy for this mechanism to drag the paper roll having an outer diameter≥Φ152.4 mm (Φ6").

Further, for allowing the paper roll supporting shaft 14 to be stably fixed to the installation frame 13, in the double-paper-roll printing device according to the present application, the paper roll supporting shaft 14 is fixed to the installation frame 13 with the aid of a fixing plate 15 and then is fastened from one end of the paper roll supporting shaft 14 by a bolt 16. For achieving fixing of all the components, as shown in FIG. 8, several fasteners 1, 4, 7, 10 and 16 are required.

Figure 9:
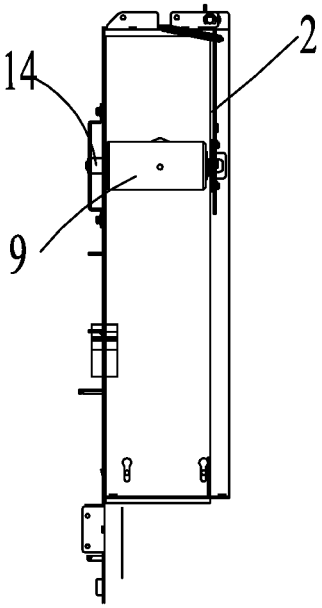
FIG. 9 is a schematic view showing a first state of the paper roll installation mechanism shown in FIG. 6 during the process of replacing a paper roll.
Figure 10:
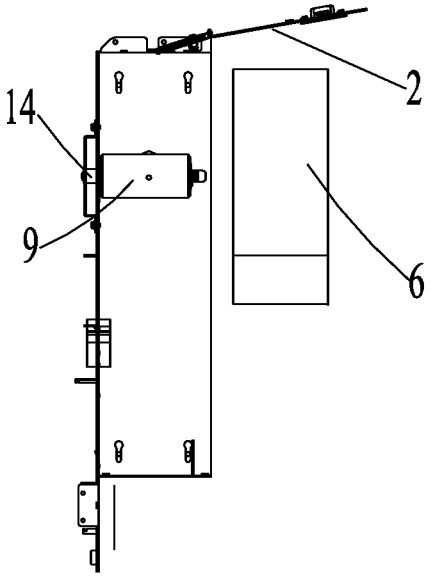
FIG. 10 is a schematic view showing a second state of the paper roll installation mechanism shown in FIG. 6 during the process of replacing a paper roll.
Figure 11:
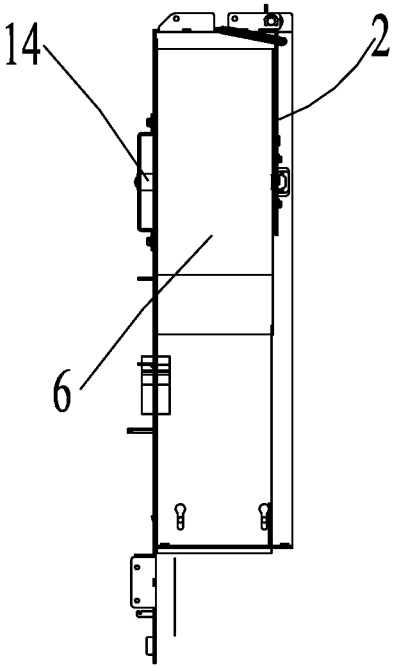
FIG. 11 is a schematic view showing a third state of the paper roll installation mechanism shown in FIG. 6 during the process of replacing a paper roll.
Figure 12:
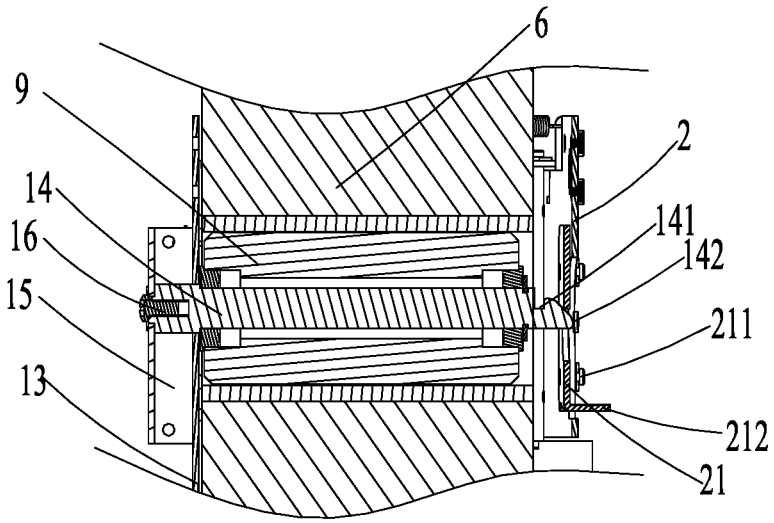
FIG. 12 is a schematic view showing a first state of a lock plate of the paper roll installation mechanism shown in FIG. 6 during the process of the lock plate locking a paper roll supporting shaft.
Figure 13:
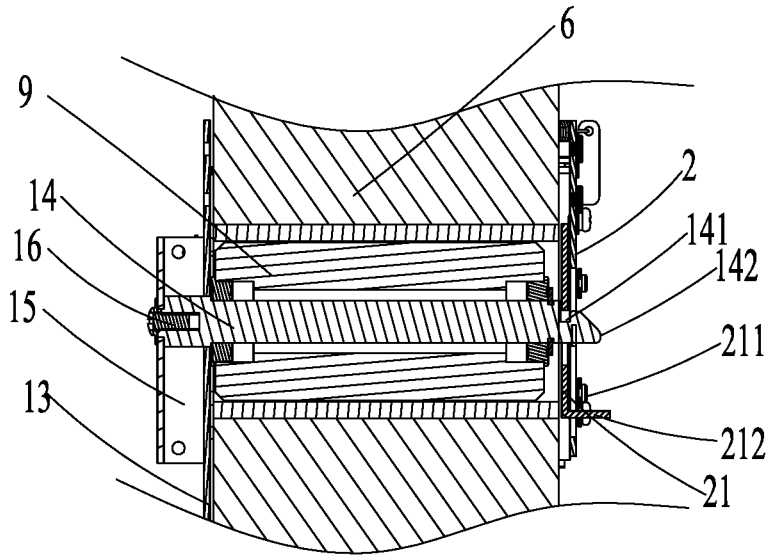
FIG. 13 is a schematic view showing a second state of a lock plate of the paper roll installation mechanism shown in FIG. 6 during the process of the lock plate locking a paper roll supporting shaft.
Figure 14:
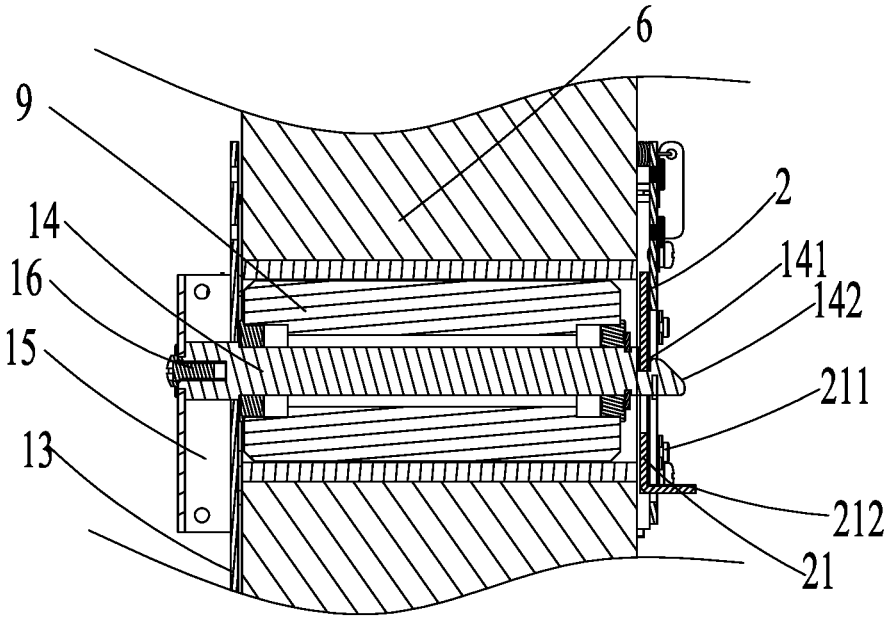
FIG. 14 is a schematic view showing a third state of a lock plate of the paper roll installation mechanism shown in FIG. 6 during the process of the lock plate locking a paper roll supporting shaft.

A paper roll replacement process of the double-paper-roll printing device according to the present application will be further described hereinafter with reference to FIGS. 9 to 14. When the paper roll 6 runs out, as shown in FIG. 9, a replacement operation is required. At this time, the operation handle 212 of the lock plate 21 is required to be lifted firstly for making the lock plate 21 away from the position-limiting slot 141 of the paper roll supporting shaft 14, as shown in FIG. 12. At this time, the movable baffle 2 may be pulled outward and then opened. The movable baffle 2 is rotated around the baffle rotation shaft 11 against the elastic force of the spring 12 to be opened. When the movable baffle 2 is rotated to allow both of the two fixing points of the tension spring 12 to be in a line with the baffle rotation shaft 11 and then this line is passed over, the movable baffle 2 is allowed to stay open under the action of the spring 12, as shown in FIG. 10. Certainly, a position-limiting mechanism is provided when the movable baffle 2 is opened in place. After an entire paper roll is installed on the paper roll shaft core 9, the movable baffle 2 is required to be closed. When the lock plate 21 of the movable baffle 2 abuts against an end head of the paper roll supporting shaft 14, the lock plate 21 is lifted under the guidance of the inclined guiding surface 142 of the end of the paper roll supporting shaft 14, as shown in FIG. 12. The movable baffle 2 is closed continuously until the lock plate 21 is passed over a highest point of the inclined guiding surface 142, as shown in FIG. 13. Since the two sides of the position-limiting slot 141 have a height difference, i.e., one side of the position-limiting slot 141 which is adjacent to the inclined guiding surface 142 is lower than the other side, the lock plate 21 is locked into the position-limiting slot 141 of the paper roll supporting shaft 14 under the action of self-gravity and a side wall of the position-limiting slot 141, as shown in FIG. 14. In this way, the replacement process of the entire paper roll is completed. The state of the paper roll installation mechanism at this time is as shown in FIG. 11. Further, it should be described that in the present application the automatic return of the lock plate 21 is achieved by self-gravity of the lock plate. Certainly, a spring or other mechanisms which may provide a return force may also be used for achieving the automatic return of the lock plate 21.

The above description is only preferred embodiments of the present application. It should be noted that the above preferred embodiments should not be construed as limiting to the present application. The protection scope of the present application should be defined by the scope defined by the claims. For the person skilled in the art, a few of modifications and improvements may be made to the present application without departing from the spirits and scope of the present application. These modifications and improvements also fall into the protection scope of the present application.

The invention claimed is:

1. A double-paper-roll printing device, comprising:

an installation frame for installing following components and paper rolls, wherein a first paper roll and a second paper roll are installed on the installation frame by a first paper roll supporting shaft and a second paper roll supporting shaft, and paper tapes of the first paper roll and the second paper roll are selectively fed to a printing component through paper passages, wherein the first paper roll and the second paper roll are selectively fed to the printing component respectively through a first paper passage and a second paper passage that are mutually independent, the first paper passage and the second paper passage are mutually superposed, and tail ends of the first paper passage and the second paper passage form an intersecting end, and paper tape heads of the paper rolls enter the printing component by the intersecting end, wherein the first paper passage and the second paper passage comprises a first paper passage top assembly, a middle assembly and a second paper passage lower assembly, and wherein the middle assembly comprises two passage faces, a first passage face and a second passage face, which are respectively adjacent to the first paper passage and the second paper passage, the first paper passage comprises the first passage face and the first paper passage top assembly, and the second paper passage comprises the second passage face and the second paper passage lower assembly, wherein the first paper passage top assembly is pivotally connected to the middle assembly, and the middle assembly is further pivotally connected to the second paper passage lower assembly.

2. The double-paper-roll printing device according to claim 1, wherein one common paper passage is provided between the printing component and the intersecting end formed by the tail ends of the first paper passage and the second paper passage.

3. The double-paper-roll printing device according to claim 2, wherein a sensor for detecting the paper tapes is provided in the common paper passage.

4. The double-paper-roll printing device according to claim 1, wherein a paper cutting assembly for cutting off the paper tape that has been printed is provided outside a paper-exit passage of the printing component.

5. The double-paper-roll printing device according to claim 4, wherein a paper delivering passage for delivering a paper sheet out is further provided outside the paper cutting assembly of the printing component, and the paper delivering passage is pivotally connected to the installation frame by one rotation shaft, and a selective separation of the paper delivering passage from the paper cutting assembly is achieved.

6. The double-paper-roll printing device according to claim 1, wherein the first paper roll and the second paper roll are supported by the first paper roll supporting shaft and second paper roll supporting shaft fixed to the installation frame, respectively, one end of each of the first paper roll supporting shaft and second paper roll supporting shaft is a free end and selectively locked by a movable baffle which is pivotally connected to the installation frame by a baffle rotation shaft.

7. The double-paper-roll printing device according to claim 6, wherein a tension spring is provided between the movable baffle and the installation frame, and the tension spring has two ends respectively fixed to the movable baffle and the installation frame.

8. The double-paper-roll printing device according to claim 6, wherein the free end of the paper roll supporting shaft is provided with a position-limiting slot, and the movable baffle is provided with a lock plate having an automatic reset function corresponding to the position-limiting slot.

* * * * *